US007726473B2

(12) United States Patent
Miyazawa et al.

(10) Patent No.: US 7,726,473 B2
(45) Date of Patent: Jun. 1, 2010

(54) CIGARETTE EJECTING BOX AND BLANK FOR SAME

(75) Inventors: Akira Miyazawa, Tokyo (JP); Tetsuya Nakamura, Tokyo (JP); Shunsuke Tawada, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 12/073,527

(22) Filed: Mar. 6, 2008

(65) Prior Publication Data

US 2008/0164162 A1 Jul. 10, 2008

Related U.S. Application Data

(63) Continuation of application No. PCT/JP2006/316743, filed on Aug. 25, 2006.

(30) Foreign Application Priority Data

Sep. 8, 2005 (JP) ..... 2005-260666

(51) Int. Cl.
*B65D 85/10* (2006.01)

(52) U.S. Cl. ..... 206/250; 206/255; 206/268; 221/248

(58) Field of Classification Search ..... 206/249–255, 206/264, 268, 270; 229/129.1; 221/247–250
See application file for complete search history.

(56) References Cited

U.S. PATENT DOCUMENTS

| | | | | | |
|---|---|---|---|---|---|
| 1,486,301 | A | * | 3/1924 | Rodgers | 206/249 |
| 1,648,074 | A | | 11/1927 | Sticht | |
| 2,148,319 | A | * | 2/1939 | Negbaur | 206/259 |
| 2,195,369 | A | * | 3/1940 | Innes | 206/804 |
| 2,833,455 | A | | 5/1958 | Planas | |
| 2,928,571 | A | * | 3/1960 | Caruso | 206/250 |
| 2,929,542 | A | | 3/1960 | O'Gorman | |
| 3,272,321 | A | | 9/1966 | Tamarin | |
| 3,282,465 | A | | 11/1966 | Davis | |
| 3,858,788 | A | | 1/1975 | Phillips, Jr. | |
| 4,240,548 | A | * | 12/1980 | Stio | 206/250 |
| 5,205,402 | A | * | 4/1993 | Maeda | 206/250 |
| 5,957,280 | A | * | 9/1999 | Focke et al. | 206/264 |

FOREIGN PATENT DOCUMENTS

| | | | |
|---|---|---|---|
| JP | 5-213340 | A | 8/1993 |
| JP | 10-181738 | A | 7/1998 |
| WO | WO-2007/029528 | A1 | 3/2007 |

* cited by examiner

*Primary Examiner*—Bryon P Gehman
(74) *Attorney, Agent, or Firm*—Birch, Stewart, Kolasch & Birch, LLP

(57) ABSTRACT

A cigarette box includes an inner case (2) enclosing a bundle of cigarettes, an outer case (8) enclosing the inner case (2) in a manner allowing the inner case (2) to be moved up and down, and having a hinged lid (12) forming a part of a top wall thereof and a window (10) formed in a side wall to partly expose the inner case (2), and a link (20) connecting the inner case (2) and the hinged lid (12). When the inner case (2) is pushed up through the window (10) of the outer case (8), the link (20) urges the hinged lid (12) upward so that hinged lid (12) is opened. In an open position, the hinged lid (12) provides an access opening (16) projecting from the plane of the top wall of the outer case (8) and facing sideways of the outer case (8).

4 Claims, 10 Drawing Sheets

CIGARETTE EJECTING BOX AND BLANK FOR SAME

This application is a Continuation of copending PCT International Application No. PCT/JP2006/316743 filed on Aug. 25, 2006, which designated the United States, and on which priority is claimed under 35 U.S.C. §120. This application also claims priority under 35U.S.C. §119(a) on Patent Application No(s). 2005-260666 filed in Japan on Sep. 8, 2005. The entire contents of each of the above documents is hereby incorporated by reference.

TECHNICAL FIELD

This invention relates to a cigarette box and a blank set for the box, where the cigarette box is used to contain an inner pack and the inner pack includes a bundle of filter cigarettes or cigarettes and a wrapper wrapping the bunch.

BACKGROUND ART

For such cigarette boxes, so-called hinged lid packages are frequently used. As disclosed in Japanese Unexamined Patent Publication No. Hei 5-213340, for example, the package of this type has a box body and a lid for opening and closing the box body, and the inner pack is contained in the box body.

Common people including smokers have been long familiar with the above-described shape of the package. Thus, there is no freshness in the package opening and closing operation, and the package of this type is poor in such visual attraction that increases the user's buying motivation.

The primary object of the present invention is to provide a cigarette box having such novel opening and closing mode that can increase the user's buying motivation, and a blank set for the box.

DISCLOSURE OF THE INVENTION

In order to achieve the above object, the cigarette box according to the present invention comprises an inner case surrounding a bundle of cigarettes and being open at the top and bottom; an outer case enclosing the inner case in a manner allowing the inner case to be moved up and down, the outer case having a hinged lid forming a part of a top wall of the outer case, and a window formed in one side wall of the outer case to partly expose the inner case, the window allowing access to the inner case to move the inner case up and down; and a link connecting the hinged lid and the inner case and enabling the hinged lid to be opened and closed in a manner interlocked with the inner case being moved up and down.

In the case of this cigarette box, the user can push up the inner case relative to the outer case with a thumb put on the inner case through the window of the outer case. The pushing-up of the inner case causes the hinged lid to be forced upward by means of the link, so that the hinged lid turns upward and opens. Then, conversely, when the user pushes down the inner case, this pushing-down operation causes the hinged lid to turn downward and close.

The above-described cigarette box provides an opening and closing mode greatly different from the common hinged lid packages and a novel appearance, and therefore greatly increases the user's buying motivation.

Specifically, the cigarette box can be configured such that when the hinged lid is opened, the hinged lid provides an access opening projecting from the plane of the top wall of the outer case and facing sideways of the outer case. In this configuration, the hinged lid is located adjacent to the one side wall of the outer case, or adjacent to the other side wall of the outer case opposite to the one side wall.

The open position of this cigarette box is unique in that the access opening faces sideways of the outer box, not to the front.

Desirably, the cigarette box should be configured such that the hinged lid includes a lid wall forming a part of the top wall of the outer case and guide walls in a pair extending from opposite side edges of the lid wall, and when the hinged lid is in a closed position, the guide walls are located within the outer case, and when the hinge lid is opened, the guide walls stick out beyond the plane of the top wall of the outer case. The guide walls of the hinged lid guide the turning of the hinged lid, thereby stabilizing the opening and closing operation.

Specifically, the cigarette box can be configured such that the lid wall includes an inner layer and an outer layer overlaid one on the other, and the link includes an arm portion extending from the inner case and stuck between the inner layer and the outer layer, and a claw projecting from the arm portion to cooperate with the arm portion to hold the inner layer between.

Further, the cigarette box can be configured such that the inner case has a bottom wall being only below the hinged lid, and when the inner case is pushed upward relative to the outer case so that the access opening projects from the plane of the top wall of the outer case, cigarettes located on the bottom wall are pushed upward with the inner case so that upper ends of the cigarettes are exposed in the access opening. According to this configuration, it is easy to take out cigarettes from the cigarette box.

The present invention further provides a blank set for forming the cigarette box, which will become apparent from the attached drawings and description below.

BEST MODE OF CARRYING OUT THE INVENTION

Figure 1:
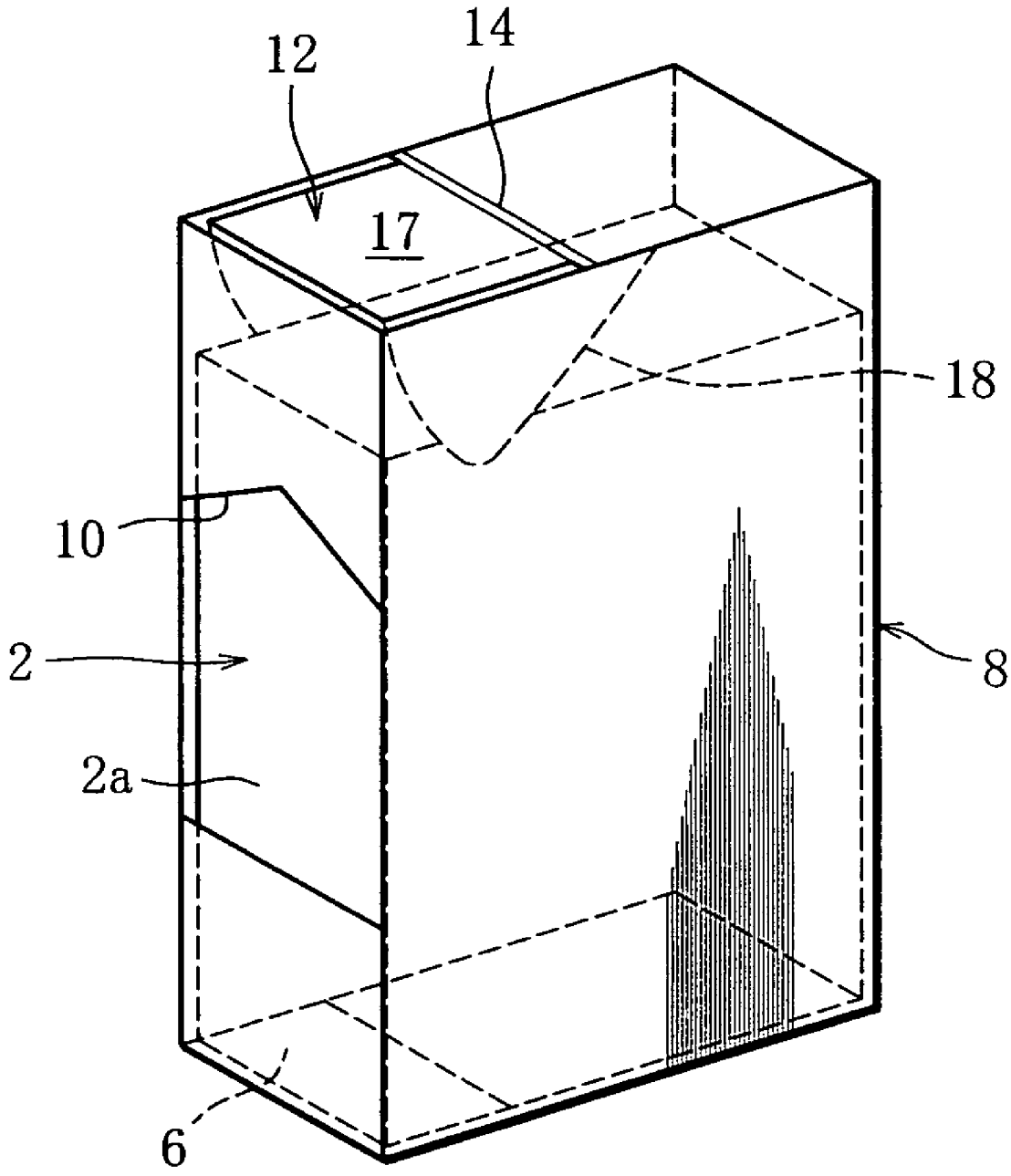
[FIG. 1] A perspective view showing an embodiment of a cigarette box in a closed state.
Figure 2:
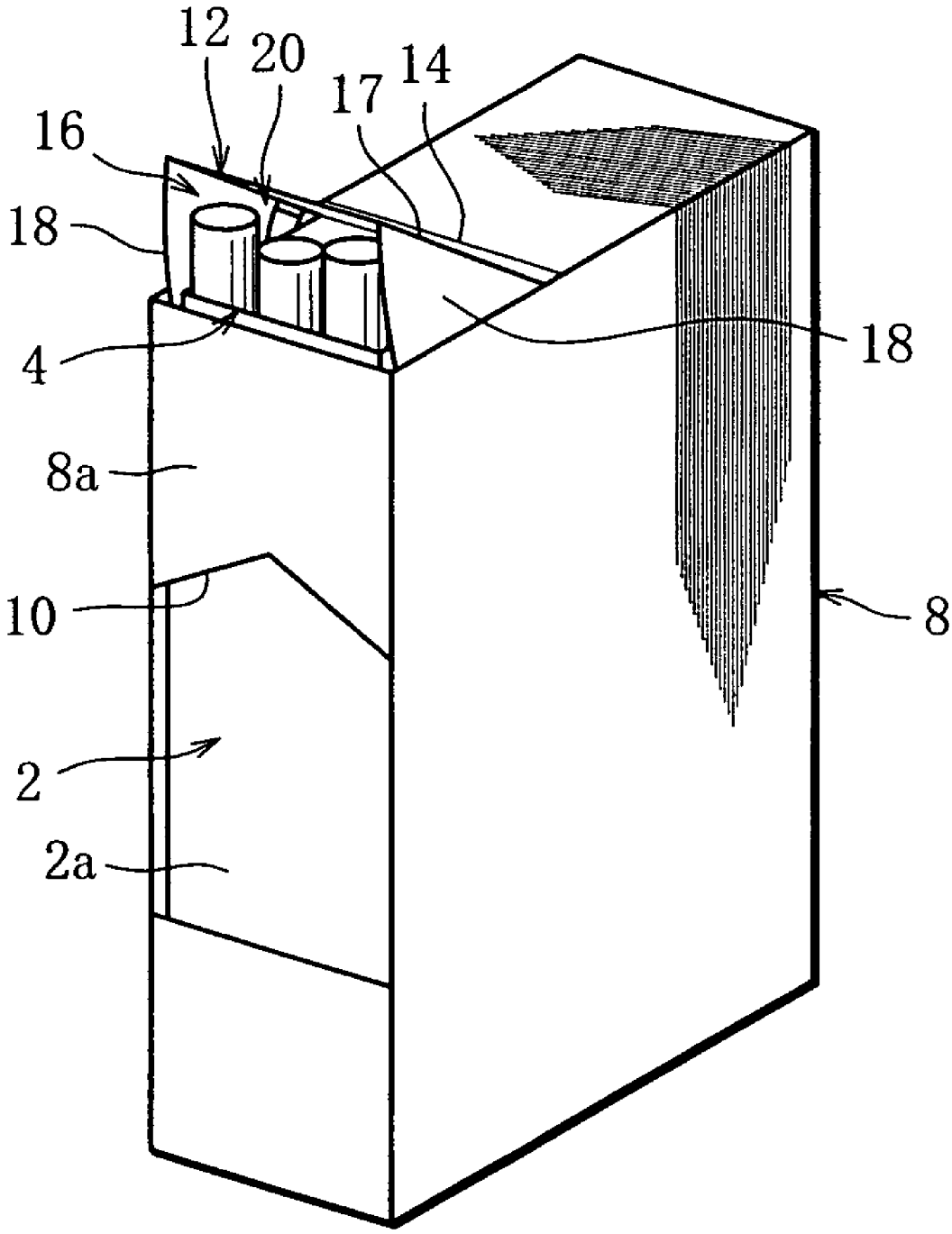
[FIG. 2] A perspective view showing the cigarette box of FIG. 1 in an open state.

FIGS. 1 and 2 show an embodiment of a cigarette box.

Figure 3:
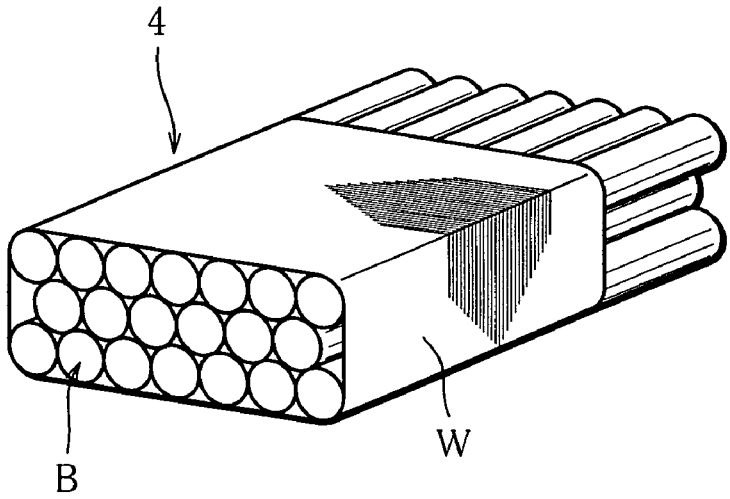
[FIG. 3] A perspective view showing an inner pack.

The cigarette box includes a parallelepiped inner case 2. The inner case 2 contains an inner pack 4. As shown in FIG. 3, the inner pack 4 includes, for example a bundle B of filter cigarettes or cigarettes and a wrapper W wrapping the bundle B. The wrapper W wraps the bundle with the top faces and lower portions of the bundle exposed.

The inner case 2 is open at the top thereof and partly closed at the bottom with a bottom wall 6. The bottom wall 6 is located adjacent to one side wall 2*a* of the inner case 2, so that the inner case 2 is open in the remaining bottom region.

The inner case 2 is contained in a parallelepiped outer case 8. The outer case 8 allows the inner case to be moved up and down. Specifically, the outer case 8 has one side wall 8*a* facing the one side wall 2*a* of the inner case 2, and a window 10 is formed in this one side wall 8*a*. The window 10 is located at the center of the one side wall 8*a* as viewed in the longitudinal direction of the one side wall 8*a*, and partly exposes the one side wall 2*a* of the inner case 2.

Further, a part of a top wall of the outer case 8 constitutes a hinged lid 12. The hinged lid 12 is located adjacent to the one side wall 8*a* of the outer case 8. The hinged lid 12 is joined to the remaining part of the top wall of the outer case 8 by a self hinge 14. The hinged lid 12 can be turned up and down around the self hinge 14. As clear from FIG. 2, when the hinged lid 12 is turned upward, the hinged lid 12 provides an access opening 16 projecting from the plane of the top wall of the outer case 8. The access opening 16 faces sideways of the cigarette box (laterally of the cigarette box).

In order to provide the access opening 16, the hinged lid 12 includes a lid wall 17 forming a part of the top wall of the outer case 8, and guide walls 18 in a pair extending from the opposite side edges of the lid wall 17. One of the guide walls 18 is held between the inner case 2 and a front wall of the outer case 8, while the other guide wall 18 is held between the inner case 2 and a rear wall of the outer case 8. When the hinged lid 12 is turned upward, the guide wall 18 sticks out beyond the upper face of the outer case 8, and when the hinged lid 12 is turned downward, the guide walls 8 sink into the outer case 8.

The inner case 2 and the hinged lid 12 are connected by coupling links 20 in a pair. The coupling links 20, which are only partly shown in FIG. 2, have a function of causing the hinged lid 12 to turn upward and downward in a manner interlocked with the upward and downward movement of the inner case 2. The specific structure of the coupling links 20 will become apparent from the description of a blank set for forming the cigarette box, given later.

In the case of the above-described cigarette box, the user can push up the inner case 2 relative to the outer case 8 and the inner pack 4 with a thumb put on the one side wall 2*a* of the inner case 2 through the window 10 of the outer case 8. As shown in FIG. 2, the pushing-up of the inner case 2 causes the hinged lid 12 to be turned upward by means of the coupling links 20, so that the access opening 16 projects from the outer case 8. Thus, the cigarette box is opened.

Since the inner case 2 has a bottom wall 6 being only on the hinged lid 12 side, when the inner case 2 is pushed up, only those cigarettes located on the bottom wall 6 are raised with the bottom wall 6, among the cigarettes in the inner pack 4, so that the upper portions of those cigarettes are exposed in the access opening 16. Thus, the user can easily take out cigarettes from the cigarette box.

Then, when the user pushes down the inner case 2, the pushing-down of the inner case 2 causes the hinged lid 12 to be turned downward by means of the coupling links 20, so that the access opening 16 sinks into the outer case 8. As the access opening sinks, the cigarettes exposed in the access opening move downward with the inner case 2, so that the cigarette box is closed as shown in FIG. 1.

As clear from the above description, when the cigarette box is opened, the hinged lid 12 provides the access opening 16 projecting from the outer case 8 and the upper portions of cigarettes appear in the access opening 16. Thus, the present embodiment of cigarette box is unique in opening and closing mode as well as appearance, compared with common hinged lid packages, and, for such uniqueness, greatly increases the user's buying motivation.

Next, a blank set for forming the cigarette box will be described. In the explanation of the blank set, FIGS. 1 and 2 are regarded as perspective views of the cigarette box viewed from the front.

Figure 4:
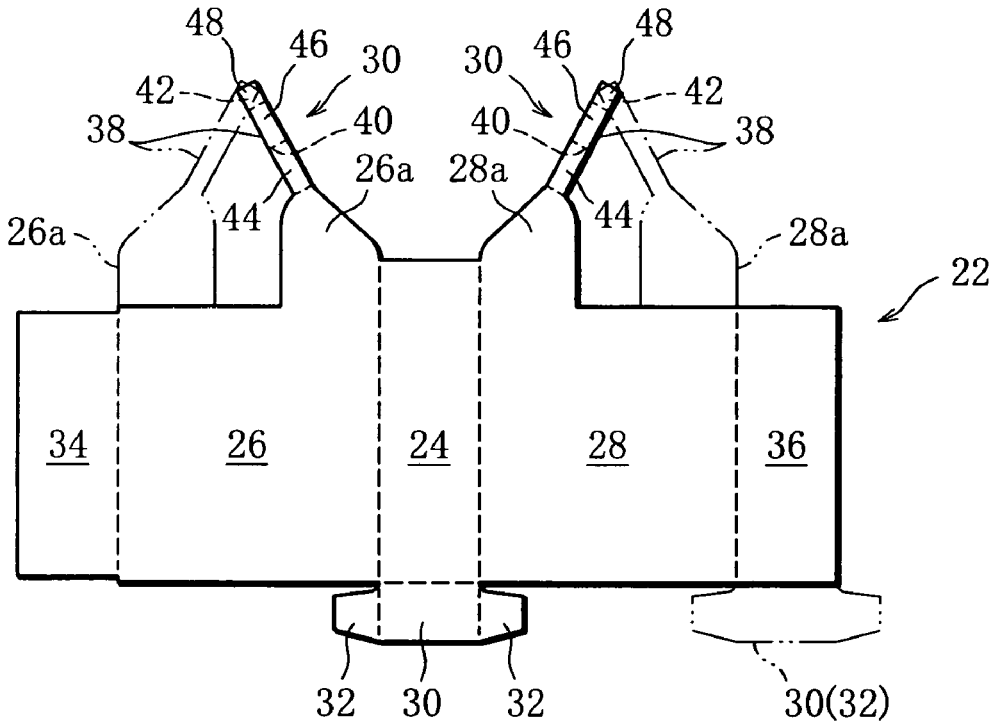
[FIG. 4] A diagram showing a blank for forming an inner case shown in FIGS. 1 and 2.

The blank set comprises two blanks. FIG. 4 shows the inner side of a blank 22 for forming the inner case 2.

The blank 22 includes a plurality of panels and a plurality of flaps, where the adjacent panels, the adjacent flaps, and the adjacent panel and flap are demarcated by fold lines shown in broken lines.

When viewed in FIG. 4, the blank 22 includes a side panel 24, a front panel 26 and a rear panel 28 arranged laterally, adjacent to one another. The side panel 24 is located between the front panel 26 and the rear panel 28, and a bottom flap 30 is joined to the lower edge of the side panel. Inner flaps 32 are joined to the opposite side edges of the bottom flap 30. Further, an inner side flap 34 and an outer side flap 36 are joined to the side edges of the front panel 26 and the rear panel 28, respectively.

The front panel 26 and the rear panel 28 have extension sections for forming the above-mentioned coupling links 20, respectively. Next, these extension sections will be described in detail.

The front panel 26 is provided with a shoulder portion 26*a* joined at the upper edge thereof. The shoulder portion 26*a* extends upward from the front panel 26. Also the rear panel 28 is provided with a shoulder portion 28*a* joined at the upper edge thereof. The shoulder portion 28*a* extends upward from the rear panel 28. The shoulder portions 26*a*, 28*a* are located adjacent to the upper portion of the side panel 24. Arm flaps 38 are joined to the shoulder portions 26*a*, 28*a*, respectively. The arm flaps extend obliquely upward, diverging from each other. Each arm flap 38 includes two fold lines 40, 42. The fold lines 40, 42 demarcate the arm flap 38 into three portions, of which the portion adjacent to the shoulder portion is called an outer arm portion 44, and the succeeding portions are called an inner arm portion 46 and a distal end portion 48, respectively.

Prior to folding the blank 22, glue is applied to the inner side thereof at specified locations. Then the blank is folded according to the process shown in FIGS. 5 to 8 to form the above-described inner case 2.

Figure 5:
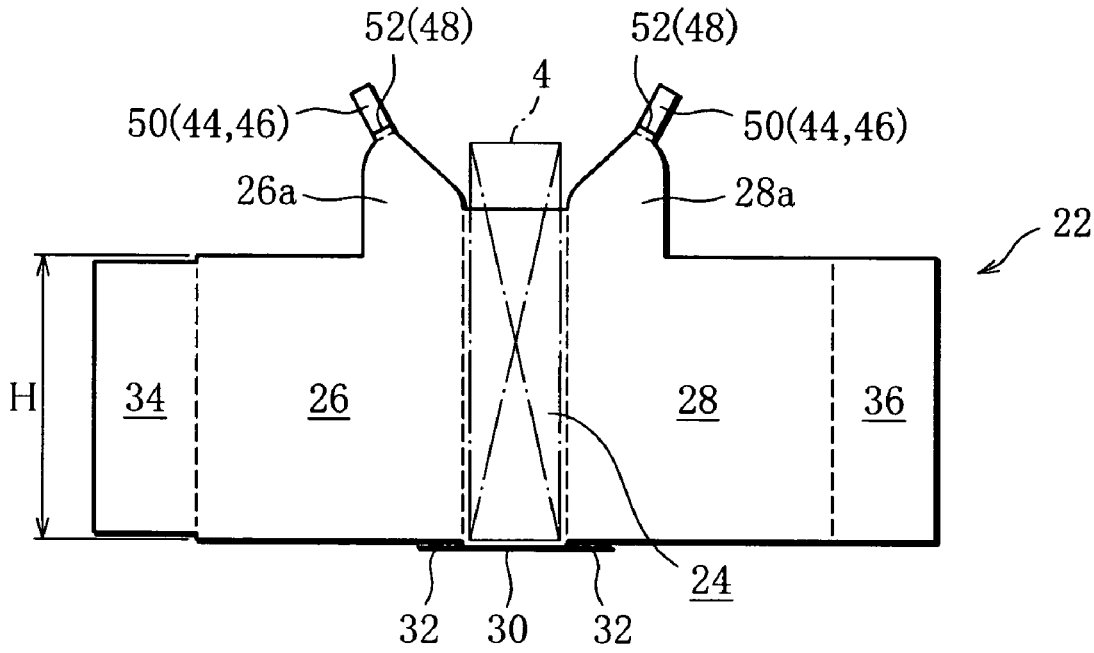
[FIG. 5] A diagram showing the state after a first folding operation is performed on the blank of FIG. 4.

As shown in FIG. 5, first, each arm flap 38 is folded along the fold line 40 so that the outer arm portion 46 is overlaid on the inner arm portion 44. The arm portions 44, 46 forms a link arm 50. At the same time as each link arm 50 is formed, the distal end portion 48 of each arm flap 38 is valley-folded along the fold line 42. The valley folding causes the distal end portion 48 to stand relative to the inner arm portion 46, or the link arm 50, so that the distal end portion 48 forms an engagement claw 52.

At the same time as each arm flap 38 is folded as described above, an inner pack 4 is supplied onto the side panel 24, namely placed on the side panel 24. The inner pack 4 is placed with a side face on the side panel 24, where the link arms 50 project beyond the upper face of the inner pack 4. The side panel 24 forms the above-mentioned one side wall 2*a* of the inner case 2.

It is to be noted that, as clear from FIG. 5, the height H of the front panel 26 and the rear panel 28 excluding the shoulder portions 26*a*, 28*b* is less than the height of the inner pack 4. The difference in height between the inner pack 4 and the panels 26, 28 allows the inner case 2 to be moved up and down relative to the outer case 8 and the inner pack 4.

Then, the bottom flap 30 with the left and right inner flaps 32 is folded toward the bottom face of the inner pack 4. The bottom flap 30 is overlaid on the bottom face of the inner pack 4 to cover it partly, thereby forming the above-mentioned bottom wall 6 of the inner case 2.

Figure 6:
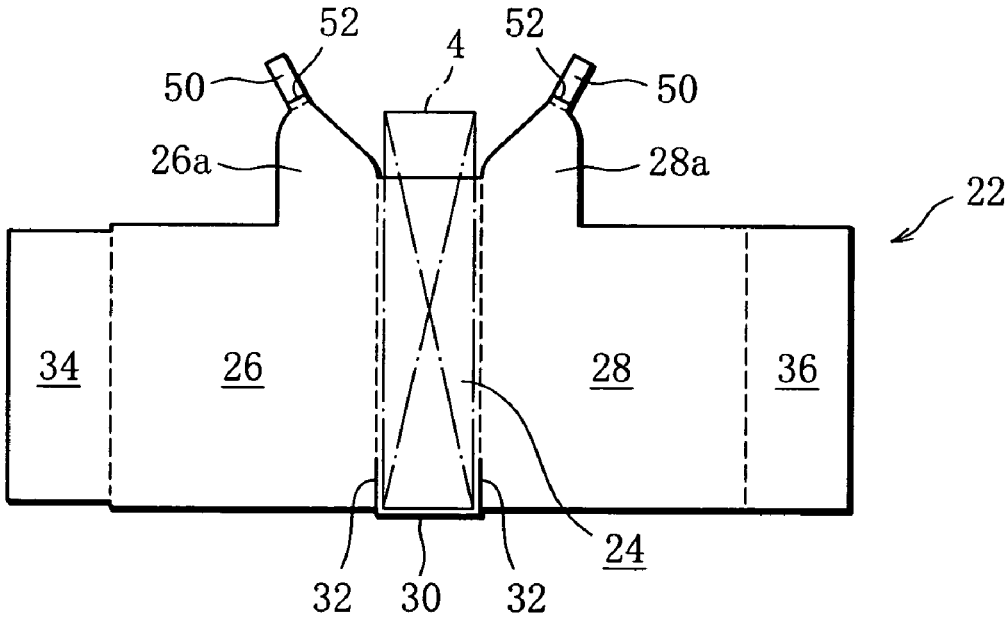
[FIG. 6] A diagram showing the state after a further folding operation is performed on the blank in the state of FIG. 5.

Next, as shown in FIG. 6, the left and right inner flaps 32 are folded toward the front and rear faces of the inner pack 4 to be overlaid on the front and rear faces, respectively, or in other words, the lower portion of the inner pack 4, and therefore of the cigarette bundle.

Figure 7:
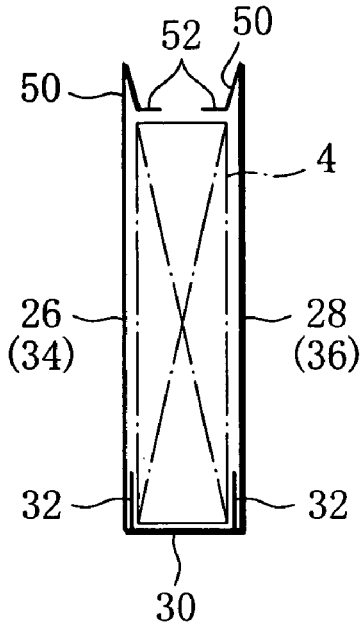
[FIG. 7] A diagram showing the state after a further folding operation is performed on the blank in the state of FIG. 6.

Next, the front panel 26 with the inner side flap 34 and the rear panel 28 with the outer side flap 36 are folded toward the front and rear faces of the inner pack 4 to be overlaid on the front and rear faces of the inner pack 4, respectively, as shown in FIG. 7. The front and rear panels 26, 28 form the front and rear walls of the inner case 2, respectively, where the link arms 50 with the engagement claws 52 face each other.

Figure 8:
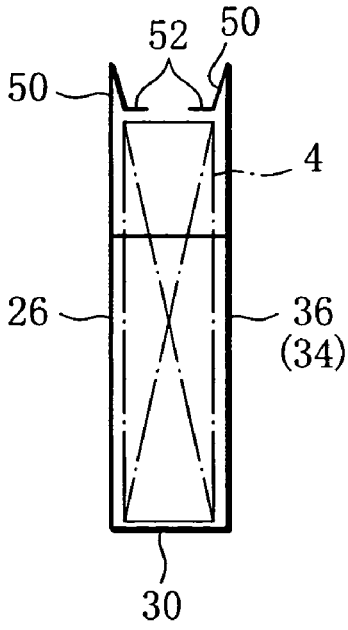
[FIG. 8] A diagram showing the state after a further folding operation is performed on the blank in the state of FIG. 7.

Then, the inner side flap 34 and the outer side flap 36 are folded toward the other side face of the inner pack 4, successively, so that the outer side flap is overlaid on the inner side flap on the other side face of the inner pack 4 as shown in FIG. 8. The side flaps 34, 36 are glued together to form the other side wall of the inner case 2. At this time, the inner pack 2 is completed. It is to be noted that the inner case 2 is not glued to the wrapper of the inner pack 4 at any location.

Figure 9:
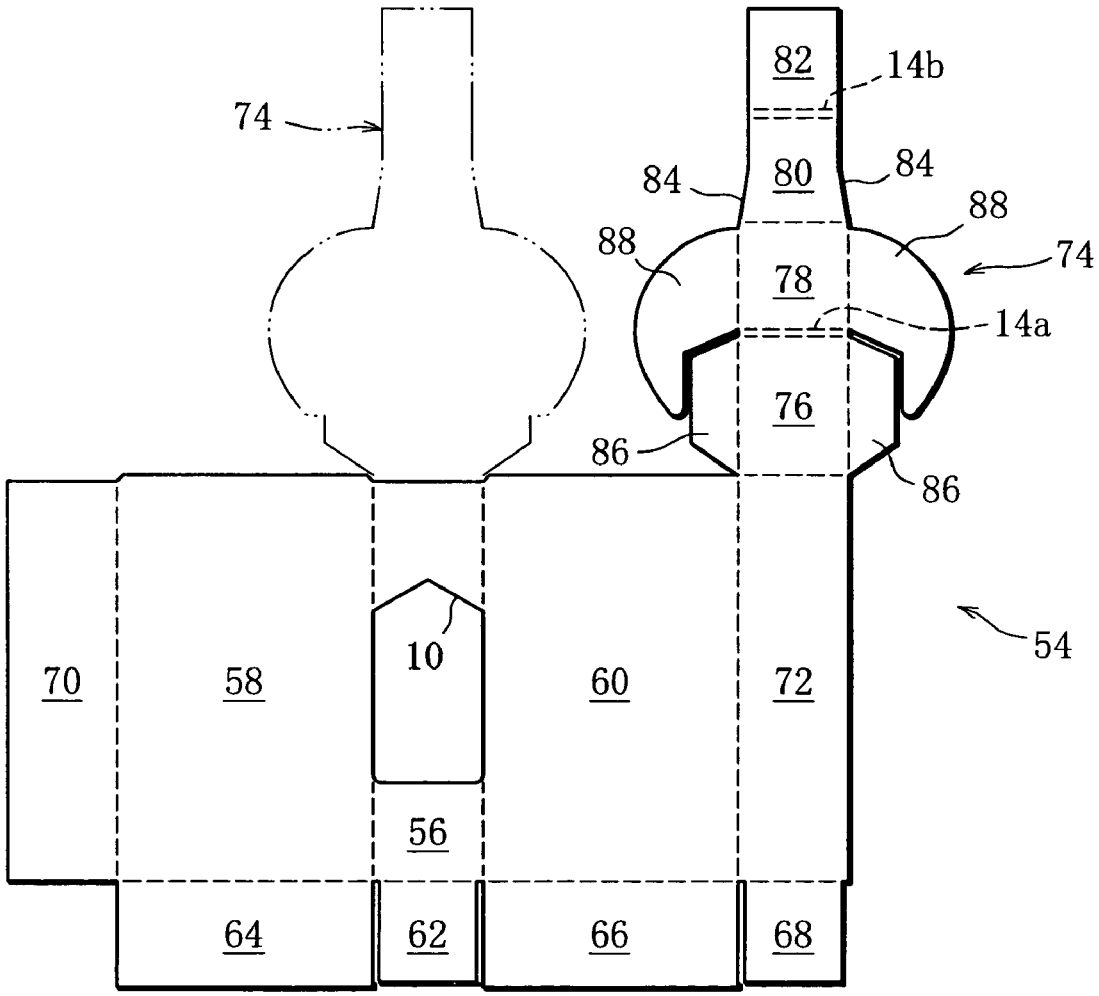
[FIG. 9] A diagram showing a blank for forming an outer case shown in FIGS. 1 and 2.

FIG. 9 shows the inner side of a blank 54 for forming the outer case 8.

Also the blank 48 includes a plurality of panels and a plurality of flaps, where the adjacent panels, the adjacent flaps, and the adjacent panel and flap are demarcated by fold lines shown in broken lines.

The blank 54 includes a side panel 56, a front panel 58 and a rear panel 60 arranged laterally in a line. The side panel 56 is located between the front panel 58 and the rear panel 60. A window 10 is formed in the side panel 56. Thus, the side panel 56 forms the above-mentioned one side wall 8*a* of the outer case 8.

When viewed in FIG. 9, an inner bottom flap 62, an outer bottom panel 64 and an inner bottom panel 66 are joined to the lower edges of the panels 56, 58 and 60, respectively. Further, an outer side flap 70 and an inner side flap 72 are joined to the side edges of the front panel 58 and the rear panel 60, respectively. Further, an inner bottom flap 68 is joined to the lower edge of the inner side flap 72.

Meanwhile, a top panel section 74 is joined to the upper edge of the inner side flap 72. The top panel section 74 extends along the longitudinal direction of the inner side flap 72.

The top panel section 74 is divided into four portions, of which the portion adjacent to the inner side flap 72 is called an outer top flap 76, and the succeeding portions are called an outer lid flap 78, an inner lid flap 80 and an inner top flap 82, respectively. A self hinge 14*a* is provided between the outer top flap 76 and the outer lid flap 78, and a self hinge 14*b* is provided between the inner lid flap 80 and the inner top flap 82. In FIG. 9, the self hinges 14*a*, 14*b* are shown in double broken lines.

The end portion of the inner lid flap 80 adjacent to the outer lid flap 78 gradually decreases in width, from the outer lid flap 78 toward the inner top flap 82, and therefore, the end portion has oblique side edges 84.

Further, inner flaps 86 are joined to the opposite side edges of the outer top flap 76, respectively, and guide flaps 88 are joined to the opposite side edges of the outer lid flap 78, respectively. As clear from FIG. 9, each guide flap 88 has a circular side edge and a lower edge which extends along the outline of the inner flap 86 to partly surround the inner flap 86.

Prior to folding the blank 54, glue is applied to the inner side of the blank 54 at specified locations. Then the blank 54 is folded according to the process shown in FIGS. 10 to 15 to form the above-described outer case 8.

Figure 10:
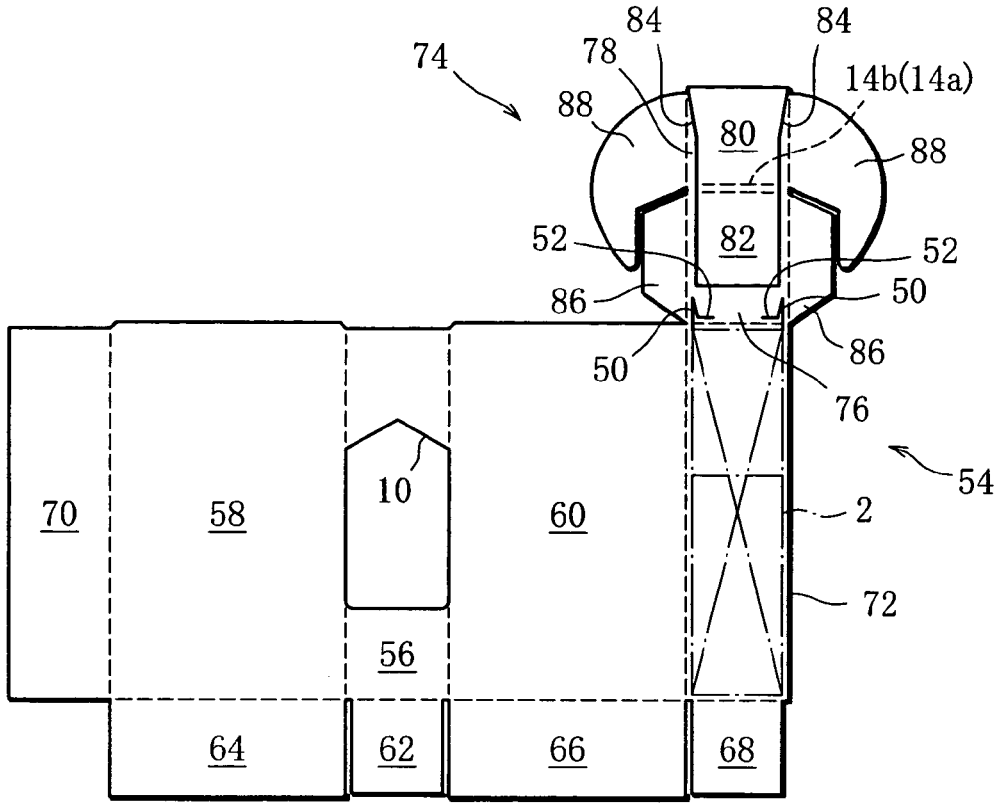
[FIG. 10] A diagram showing the state after a first folding operation is performed on the blank of FIG. 9.

As shown in FIG. 10, first, the top panel section 74 is folded along the fold line between the outer lid flap 78 and the inner lid flap 80. As a result of this folding, the inner lid flap 80 is overlaid on the outer lid flap 78 and the inner top flap 82 is overlaid on the outer top flap 76.

As clear from FIG. 10, when the inner lid flap 80 is overlaid on the outer lid flap 78, the self hinges 14*a*, 14*b* meet so that the flaps 78, 80 form a part of the top wall of the outer case 8, i.e., the lid wall 17 of the hinged lid 12. It is to be noted that the flaps 78, 80 are not glued together. Meanwhile, the outer top flap 76 and the inner top flap 82 overlaid one on the other are glued together to form the remaining part of the top wall of the outer case 8.

At the same time as the top panel section 74 is folded as described above, the above-described inner case 2 is supplied onto the inner side flap 72. As shown in FIG. 10, the inner case 2 is placed with the above-mentioned one side wall 2*a* (side panel 24) up and the other side wall down on the inner side flap 72, where the left and right link arms 50 of the inner case 2 project beyond the upper edge of the inner side flap 72 (top face of the inner pack 4).

Figure 11:
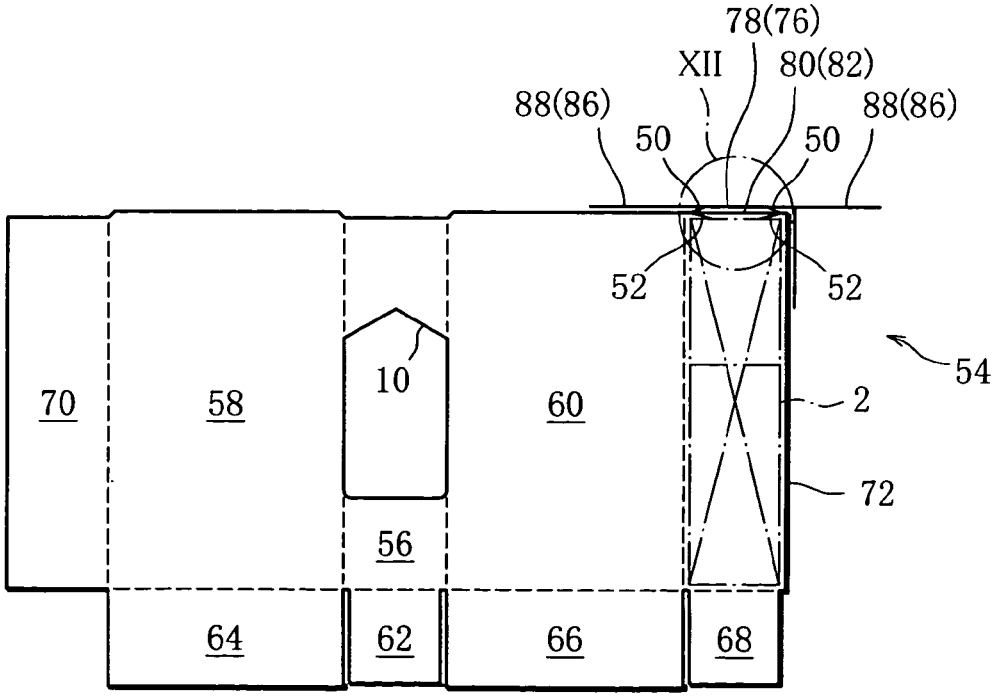
[FIG. 11] A diagram showing the state after a further folding operation is performed on the blank in the state of FIG. 10.

Next, as shown in FIG. 11, the top panel section 74 is folded along the fold line between this section 74 and the inner side flap 72, toward the top face of the inner pack 4 within the inner case 2. As a result of this folding, the lid wall 17 and the remaining part of the top wall of the outer case is overlaid on the top face of the inner pack 4.

At this time, since the inner lid flap 80 constituting the lid wall 17 has the above-mentioned oblique edges 84, the distal ends of the left and right link arms 50 of the inner case 2 do not collide with the inner lid flap 80 but collide with the outer lid flap 78 constituting the lid wall 17, and are pressed by the outer lid flap 78.

Figure 12:
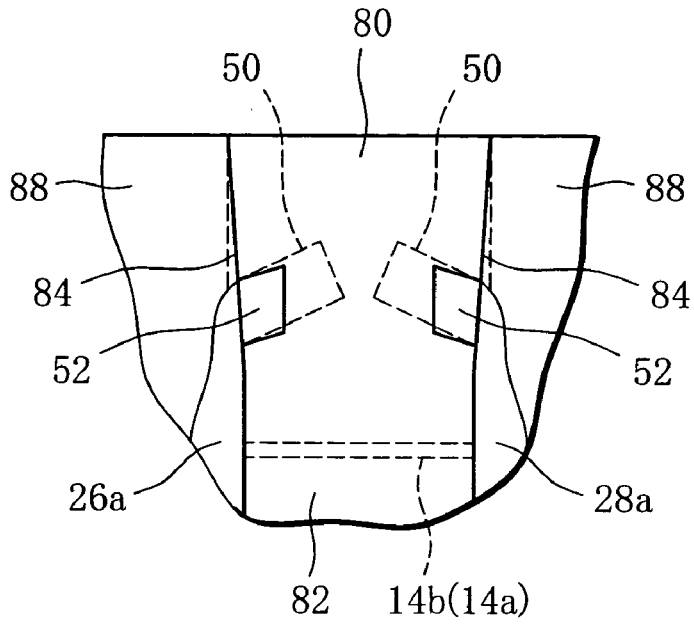
[FIG. 12] A diagram showing a portion XII of a lid wall indicated in FIG. 11, viewed from the inner side, on an enlarged scale.

Here, the proximal end of each link arm 50 (arm flap 38) is joined to the corresponding shoulder potion 26*a* or 28*a* by a fold line, the direction of inclination of each link arm 50 intersects with the direction of inclination of the corresponding oblique edge 84, and the flaps 78, 80 constituting the lid wall 17 are not glued together. Thus, when the link arms 50 are pressed by the lid wall 17, the link arms 50 bend and come in between the flaps 78, 80, where the oblique edges 84 of the inner lid flap 80 guide the distal ends of the link arms 50. Consequently, as shown in FIG. 12, the inner flap 80 is held between the link arms 50, which are stuck between the flaps, and the engagement claws 52.

Thus, the link arms 50 and the engagement claws 52 cooperate to connect the lid wall 17 of the hinged lid 12 and the inner case 2, and these link arms 50 and engagement claws 52 constitute the above-mentioned coupling links 20. Specifically, as already mentioned, when the inner case 2 is pushed up, the coupling links 20 urges the lid wall 17 of the hinged lid 12 upward, thereby causing the hinged lid 12 to turn around the self hinge 14 upward.

Figure 13:
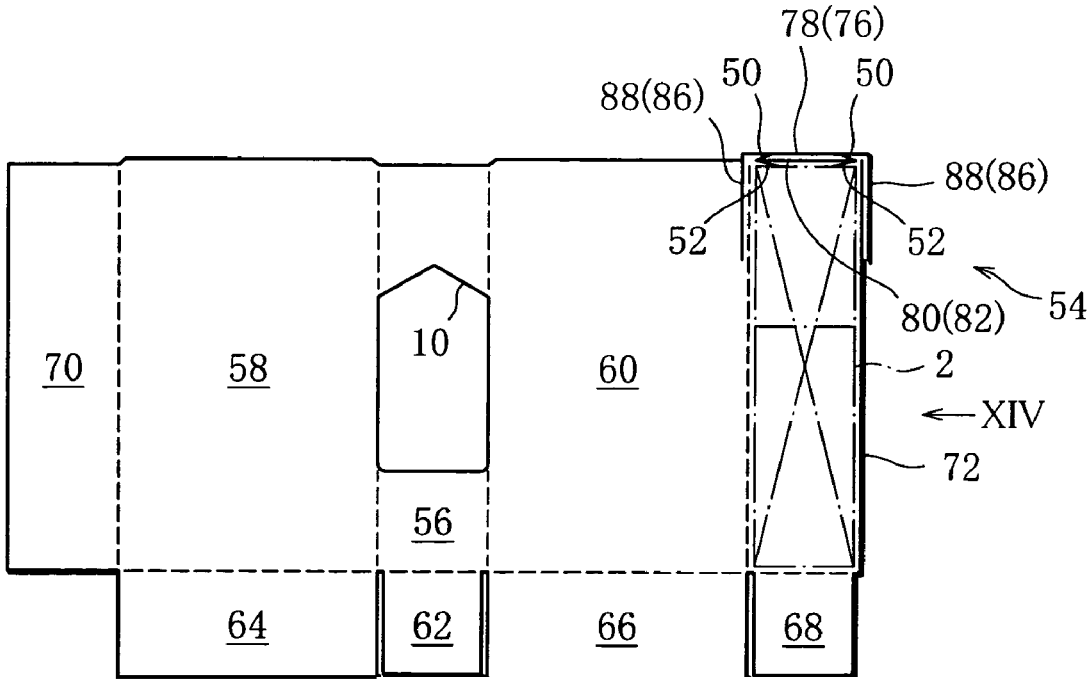
[FIG. 13] A diagram showing the state after a further folding operation is performed on the blank in the state of FIG. 11.
Figure 14:
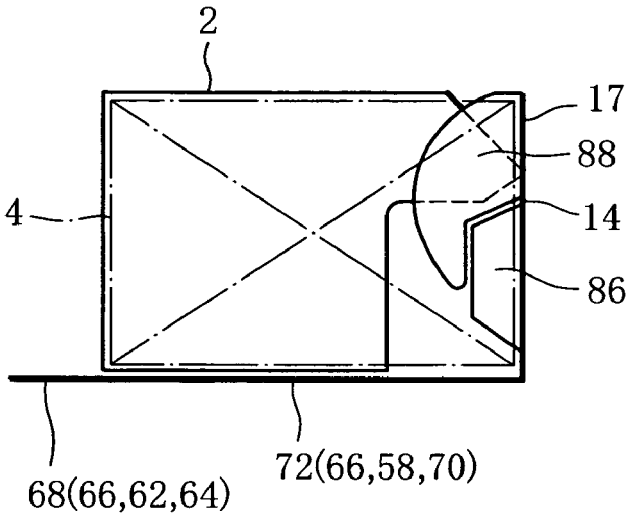
[FIG. 14] A diagram showing the folded blank viewed from direction XIV as indicated by an arrow in FIG. 13.
Figure 15:
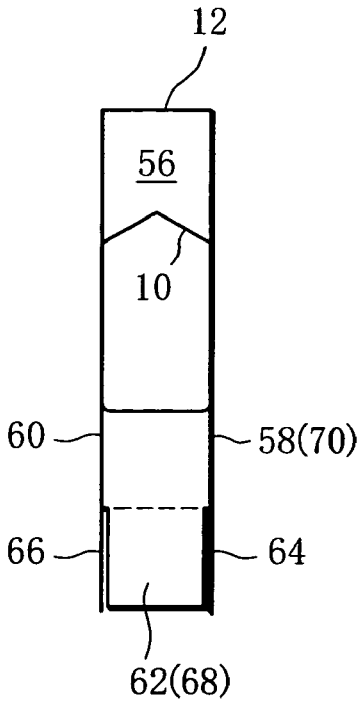
[FIG. 15] A diagram showing the state after a further folding operation is performed on the blank in the state of FIG. 13.

Next, as shown in FIG. 13, the inner flaps 86 in a pair and the guide flaps 88 in a pair of the top panel section 74 are folded toward the inner case 2 to be overlaid on the front face and rear face of the inner pack 4, respectively. More specifically, as shown in FIG. 14, the inner flaps 86 are positioned without being overlaid on the inner case 2 and glued to that portion of the wrapper which constitutes the upper face of the inner pack 4. Meanwhile, the guide flaps 88 are overlaid on the corresponding shoulder portions 26*a* and 28*a*, respectively, but not glued to the inner case 2 nor the wrapper constituting the inner pack 4, and form the guide walls 18 of the hinged lid 18.

Next, the rear panel 60, the side panel 56 and the front panel 58 are folded over the inner case 2, successively. The panels 60, 56, 58 are overlaid on the rear wall, first side wall 2*a* and front wall of the inner case 2, respectively, to form the rear wall, one side wall 8*a* and the front wall of the outer case 8, respectively, as clear from FIG. 15.

Then, the inner bottom flaps 62, 68 are folded toward the bottom face of the inner case 2 to be overlaid on the bottom face of the inner case 2. Further, the inner bottom panel 66 and the outer bottom panel 64 are folded toward the bottom face of the inner case 2, successively, so that the bottom panels 64, 66 are overlaid one on the other, on the bottom face of the inner case 2 and the flaps 62, 68. The bottom panels 64, 66 are glued together to form the bottom wall of the outer case 8 with the inner bottom flaps 62, 68.

Last, the outer side flap 70 joined to the front panel 58 is folded toward the inner side flap 72 to be overlaid on the inner side flap 72. The side flaps 70, 72 are glued together to form the other side wall of the outer case 8. At this time, the cigarette box shown in FIG. 1 is completed.

The present invention is not limited to the above-described embodiment.

Figure 16:
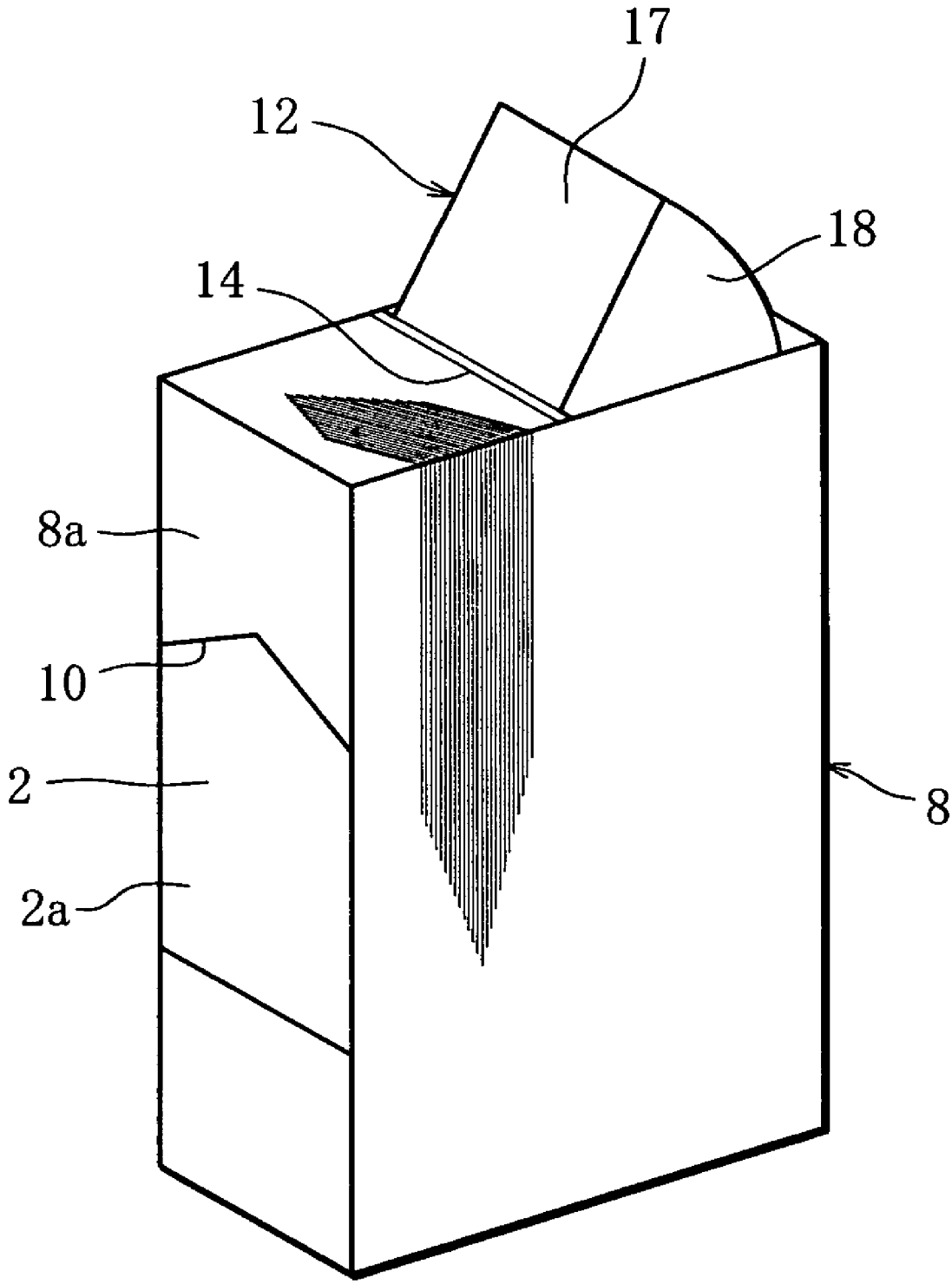
[FIG. 16] A perspective view showing a variant of the cigarette box.

For example, as shown in FIG. 16, the hinged lid 12 can be disposed adjacent to the other side wall of the outer case 8. In this case, the blank 22 is modified such that the shoulder portion 26*a* with the arm flap 38 joined to the front panel 26, the shoulder portion 28*a* with the arm flap 38 joined to the rear panel 28, and the bottom flap 30 with the inner flaps 32 in a pair are disposed as indicated by two-dot chain lines in FIG. 4, and the blank 54 is modified such that the top panel section 74 is joined to the upper edge of the side panel 56 as indicated by two-dot chain lines in FIG. 9.

Further, the coupling links 20 for connecting the inner case 2 and the outer case 8 may include components different from the described link arms 50 and engagement claws 52.

The invention claimed is:

1. A cigarette box, comprising:

an inner case surrounding a bundle of cigarettes and being open at the top and bottom thereof, an outer case enclosing said inner case in a manner allowing said inner case to be moved up and down, said outer case having a hinged lid forming a part of a top wall of said outer case, and a window formed in one side wall of said outer case to partly expose said inner case, the window allowing access to said inner case to move said inner case up and down, and a link for connecting the hinged lid and said inner case and enabling the hinged lid to be opened and closed in a manner interlocked with said inner case being moved up and down, wherein the hinged lid is located adjacent to the one side wall of said outer case and includes a lid wall forming a part of the top wall of said outer case and guide walls in a pair extending from opposite side edges of the lid wall, wherein when the hinge lid is in a closed position, the guide walls are located within said outer case, and when the hinged lid is opened, the guide walls stick out beyond a plane of the top wall of said outer case so that an access opening is provided, the access opening projecting from the plane of the top wall of said outer case and facing sideways of said outer case.

2. The cigarette box according to claim 1, wherein the lid wall includes an inner layer and an outer layer overlaid one on the other, and the link includes an arm portion extending from said inner case and stuck between the inner layer and the outer layer, and a claw projecting from the arm portion to cooperate with the arm portion to hold the inner layer.

3. The cigarette box according to claim 1, wherein said inner case has a bottom wall being only below the hinged lid, and when said inner case is pushed upward relative to said outer case so that the access opening projects from the plane of the top wall of said outer case, cigarettes located on the bottom wall are pushed upward with said inner case so that upper ends of the cigarettes are exposed in the access opening.

4. A blank set for forming the cigarette box according to claim 1, comprising:

an inner blank for forming said inner case, and an outer blank for forming said outer case, said inner blank including:

a front panel, a side panel and a rear panel for forming a front wall, a first side wall and a rear wall of said inner case, the front panel, the side panel and the rear panel being arranged laterally in a line, where the front, side, and rear panels are demarcated by fold lines from each other, side flaps in a pair for forming, in cooperation with each other, another side wall of said inner case, the side flaps being jointed to side edges of the front and rear panels across fold lines, respectively, extension sections in a pair for forming said link, the extension sections extending from end edges of the front and rear panels for forming top edges of the front and rear walls of said inner case, and each including a plurality of portions demarcated by fold lines, said outer blank including:

a front panel, a side panel with the window, and a rear panel for forming a front wall, the one side wall and a rear wall of said outer case, respectively, the front panel, the side panel and the rear panel being arranged laterally in a line and demarcated by fold lines from each other, side flaps in a pair for forming another side wall of said outer case in cooperation with each other, the side flaps being jointed to side edges of the front and rear panels across fold lines, respectively, bottom flaps in a pair for forming a bottom wall of said outer case in cooperation with each other, the bottom flaps being jointed to end edges of the front and rear panels to be located in the bottom wall side of said outer case, and a top panel section for forming the lid wall and guide walls of the hinged lid, the lid wall forming a part of the top wall of said outer case, and the remainder of the top wall, the top panel section being joined to an end edge of any one of the side flaps to be located in the top wall side of said outer case across a fold line.

* * * * *